US008783050B2

(12) United States Patent
Okamoto et al.

(10) Patent No.: US 8,783,050 B2
(45) Date of Patent: Jul. 22, 2014

(54) HEAT SOURCE UNIT

(75) Inventors: Atsushi Okamoto, Shanghai (CN); Shinya Matsuoka, Sakai (JP); Takuya Kotani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 198 days.

(21) Appl. No.: 13/264,404

(22) PCT Filed: Apr. 16, 2010

(86) PCT No.: PCT/JP2010/002779

§ 371 (c)(1),
(2), (4) Date: Oct. 14, 2011

(87) PCT Pub. No.: WO2010/119705

PCT Pub. Date: Oct. 21, 2010

(65) Prior Publication Data

US 2012/0024008 A1 Feb. 2, 2012

(30) Foreign Application Priority Data

Apr. 17, 2009 (JP) ..... 2009-101317

(51) Int. Cl.

| | |
|---|---|
| ***F25B 41/00*** | (2006.01) |
| ***F25B 49/00*** | (2006.01) |
| ***F25B 41/04*** | (2006.01) |
| ***F25B 43/00*** | (2006.01) |

(52) U.S. Cl.
USPC ..... 62/196.1; 62/210; 62/222; 62/512

(58) Field of Classification Search
USPC ..... 62/222, 210, 196.1, 512
See application file for complete search history.

(56) References Cited

U.S. PATENT DOCUMENTS

| | | | | |
|---|---|---|---|---|
| 4,901,533 | A * | 2/1990 | Fan et al. | 62/614 |
| 5,737,931 | A * | 4/1998 | Ueno et al. | 62/126 |
| 5,970,721 | A | 10/1999 | Kamimura et al. | |
| 6,209,338 | B1 * | 4/2001 | Thatcher, Jr. | 62/292 |
| 7,980,086 | B2 | 7/2011 | Kotani et al. | |
| 2007/0283712 | A1 * | 12/2007 | Taras et al. | 62/324.1 |
| 2010/0107660 | A1 | 5/2010 | Kawano et al. | |
| 2010/0223940 | A1 | 9/2010 | Kotani et al. | |

FOREIGN PATENT DOCUMENTS

| | | | |
|---|---|---|---|
| EP | 1818627 | A1 * | 8/2007 |
| JP | 48-74641 | A | 10/1973 |
| JP | 9-329375 | A | 12/1997 |
| JP | 2000-28237 | A | 1/2000 |
| JP | 2000-292037 | A | 10/2000 |
| JP | 2002-195705 | A | 7/2002 |
| JP | 2007-198642 | A | 8/2007 |
| WO | WO 2008/132982 | A1 | 11/2008 |

* cited by examiner

*Primary Examiner* — Judy Swann
*Assistant Examiner* — Zachary R Anderegg
(74) *Attorney, Agent, or Firm* — Birch, Stewart, Kolasch & Birch, LLP.

(57) ABSTRACT

A time for loading a refrigerant is shortened when a utilization unit of an air conditioner is installed. A heat source unit 1 includes a compressor 100; a heat-source-side heat exchanger 200; a refrigerant regulator 61 storing a refrigerant; an introducing pipe 62 which is a pipe that is branched off from a discharge-side pipe 110 of the compressor 100 and connected to the refrigerant regulator 61, and introduces the refrigerant discharged from the compressor 100 into the refrigerant regulator 61; and a lead-out pipe 63 which is a pipe that is connected from the refrigerant regulator 61 to an intake-side pipe 120 of the compressor 100, and leads out the refrigerant stored in the refrigerant regulator 61 into the intake-side pipe 120.

5 Claims, 7 Drawing Sheets

HEAT SOURCE UNIT

TECHNICAL FIELD

The present invention relates to a heat source unit of an air conditioner that is connected to a utilization unit provided with a utilization-side heat exchanger.

BACKGROUND ART

An operation of loading a refrigerant into a refrigerant circuit of an air conditioner is necessary to start a trial run after the air conditioner has been installed. Patent Document 1 discloses a technique for automatically determining when such a refrigerant loading operation is completed. In the air conditioner disclosed in Patent Document 1, a cylinder operation is necessary for the aforementioned loading operation, but an air conditioner is also known in which the cylinder operation is made unnecessary by preparing in advance a refrigerant regulator, which is a tank filled with the refrigerant.

In the conventional heat source unit provided with the refrigerant regulator, the refrigerant located in the refrigerant regulator is loaded into the refrigerant circuit by connecting to the refrigerant regulator an introducing pipe that is branched off from a discharge-side pipe of the compressor and a lead-out pipe connected to a liquid pipe through which passes the liquid refrigerant after condensation. Thus, the high-pressure gaseous refrigerant discharged from the compressor is introduced into the refrigerant regulator through the introducing pipe, and the refrigerant located inside the refrigerant regulator that has been pressurized by this high-pressure gaseous refrigerant is led out to the lead-out pipe and loaded into the refrigerant circuit. However, since the liquid refrigerant inside the liquid pipe is under a high pressure, even if the liquid refrigerant is pressurized by the high-pressure gas refrigerant, the pressure inside the refrigerant regulator can be increased only slightly above the pressure of liquid refrigerant inside the liquid pipe, a long time is required to complete the loading of the refrigerant from the refrigerant regulator into the refrigerant circuit, the refrigerant loading operation becomes the rate-determining operation, and the trial run time is extended.

Patent Document 1: Japanese Patent Application Laid-open No. 2007-198642

SUMMARY OF THE INVENTION

The present invention has been created to resolve the above-described problems and it is an object thereof to enable rapid loading of the refrigerant located in the refrigerant regulator into the refrigerant circuit.

The heat source unit according to one aspect of the present invention is a heat source unit of an air conditioner connected to a utilization unit provided with a utilization-side heat exchanger, including:

a compressor (100);

a heat-source-side heat exchanger (200);

a refrigerant regulator (61) storing a refrigerant;

an introducing pipe (62) which is a pipe that is branched off from a discharge-side pipe (110) of the compressor (100) and connected to the refrigerant regulator (61), and introduces the refrigerant discharged from the compressor (100) into the refrigerant regulator (61); and a lead-out pipe (63) which is a pipe that is connected from the refrigerant regulator (61) to an intake-side pipe (120) of the compressor (100), and leads out the refrigerant stored in the refrigerant regulator (61) into the intake-side pipe (120).

DESCRIPTION OF EMBODIMENTS

Embodiment 1

Figure 1:
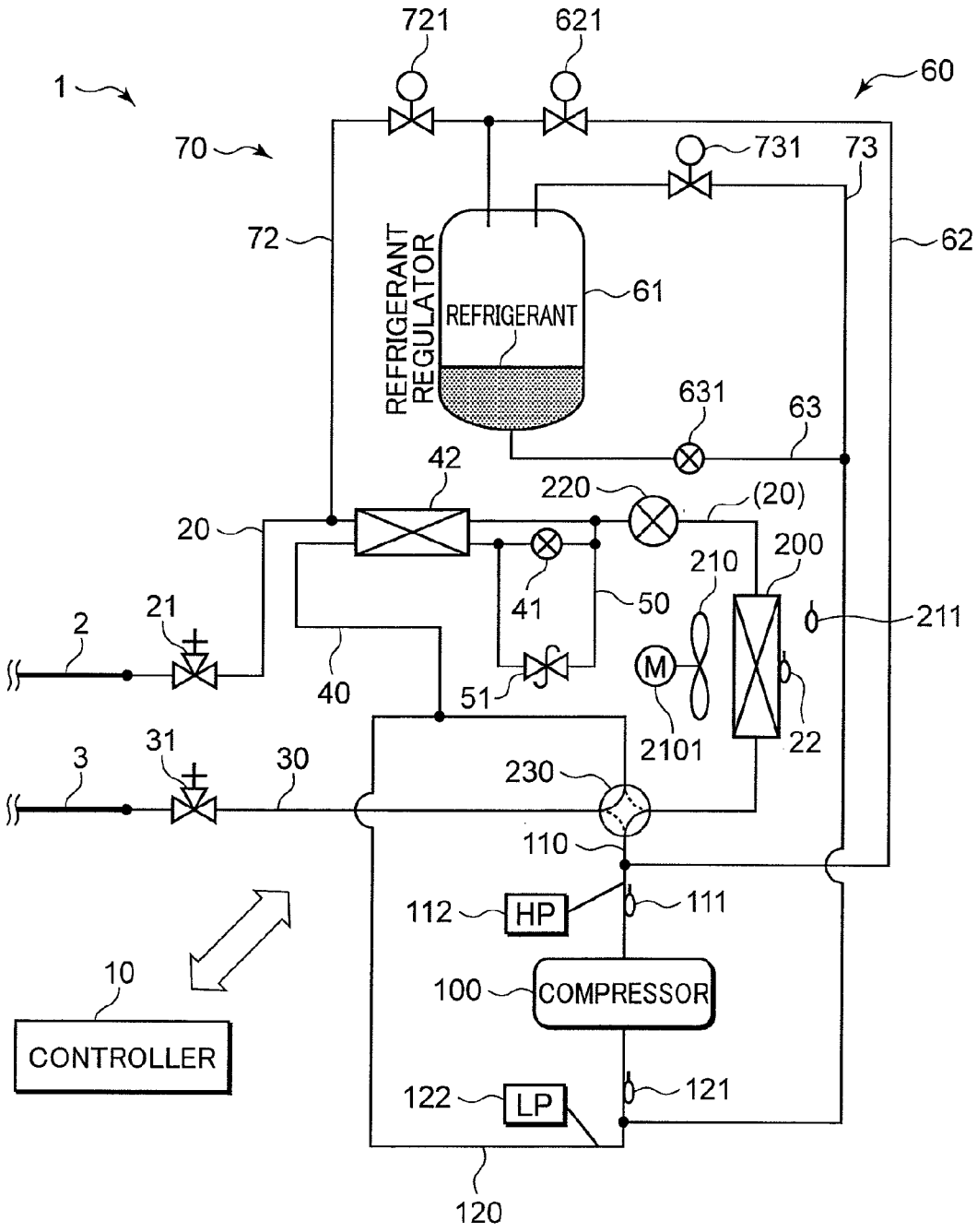
FIG. 1 is a schematic configuration diagram of a heat source unit according to Embodiment 1 of the present invention.
Figure 2:
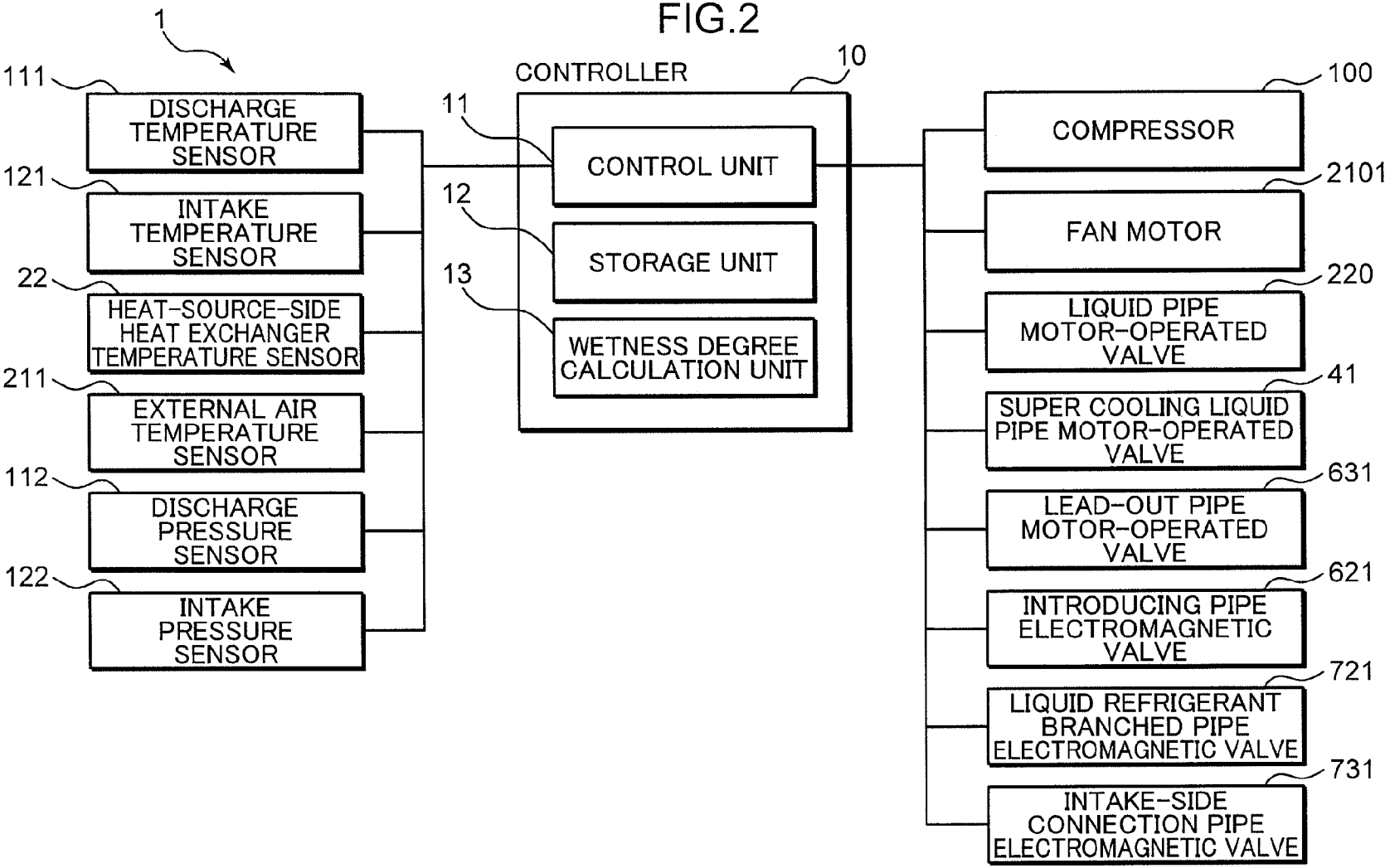
FIG. 2 is a functional block diagram illustrating the schematic configuration of the control system and principal structure of the heat source unit according to Embodiment 1 of the present invention.
Figure 3:
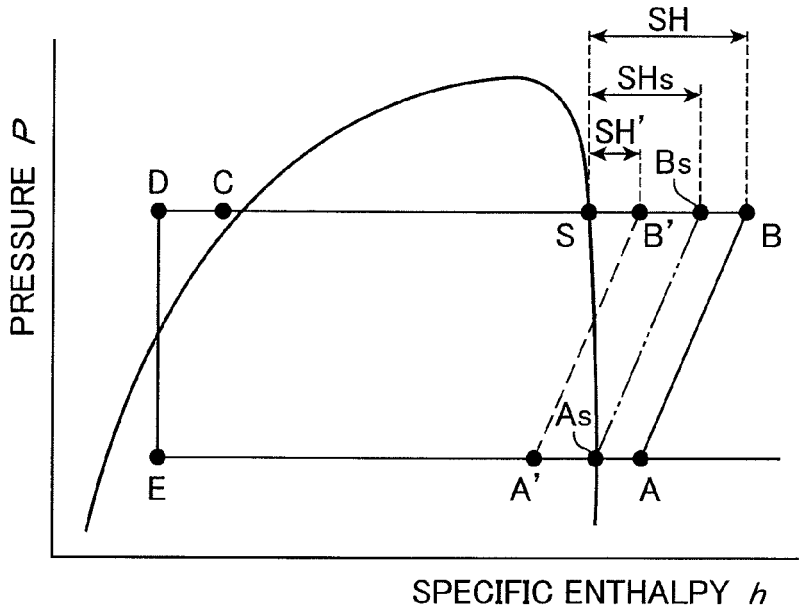
FIG. 3 is a Mollier diagram illustrating a refrigeration cycle in the refrigerant circuit constituted by providing the heat source unit according to Embodiment 1 of the present invention.

A heat source unit of an air conditioner according to Embodiment 1 of the present invention will be explained below with reference to the appended drawings. FIG. 1 is a schematic configuration diagram of a heat source unit 1 according to Embodiment 1 of the present invention. FIG. 2 is a functional block diagram illustrating the schematic configuration of the control system and principal structure of the heat source unit 1. FIG. 3 is a Mollier diagram (pressure-specific enthalpy diagram, p-h diagram) illustrating a refrigeration cycle in the refrigerant circuit constituted by providing the heat source unit 1.

The heat source unit 1 according to the present embodiment is, for example, the so-called updating heat source unit for updating the heat source unit of the already installed refrigerant circuit, while using the refrigerant piping constituting the already installed refrigerant circuit. The heat source unit 1 is connected to a utilization unit (not shown in the figure) provided with a utilization-side heat exchanger by means of a liquid refrigerant connection pipe 2 that is connected to one end side of the utilization-side heat exchanger and has a liquid refrigerant flowing therein, and a gaseous refrigerant connection pipe 3 connected to the other side of the utilization-side heat exchanger and having a gaseous refrigerant flowing therein.

As shown in FIG. 1, the heat source unit 1 is provided with a compressor 100, a heat-source-side heat exchanger 200, a liquid pipe motor-operated valve 220, a liquid refrigerant pipe 20 located in the heat source unit, a gaseous refrigerant pipe 30 located in the heat source unit, a supercooling refrigerant pipe 40, a bypass pipe 50, a pressure regulating valve 51 (first liquid refrigerant escape mechanism), a liquid refrigerant loading mechanism 60, a second liquid refrigerant escape mechanism 70, and a controller 10.

The compressor 100 is, for example, a scroll compressor of an inverter control system such that the capacity thereof can be adjusted by changing the drive frequency. The compressor 100 compresses the low-pressure gaseous refrigerant to a pressure equal to or higher than a critical pressure (from point A to point B in FIG. 3).

The controller 10 is constituted, for example, by a CPU (Central Processing Unit), a ROM (Read Only Memory), and the like and functions so as to realize a control unit 11, a storage unit 12, and a wetness degree calculation unit 13, as shown in FIG. 2. The control unit 11 controls the refrigeration cycle in the refrigerant circuit to which the heat source unit 1 is connected by controlling the drive frequency of the compressor 100, opening/closing of the below-described electromagnetic valves, and the opening degree of the below-described motor-operated valves on the basis of the measurement values of the below-described sensors. The storage unit 12 stores a control program or the like of the heat source unit 1 and also stores, as appropriate, the measurement values obtained by the sensors. The calculation unit 13 calculates a wetness degree, which is a ratio of the liquid refrigerant contained in the refrigerant flowing into an intake portion of the compressor 100, on the basis the temperature of the discharged gas of the compressor 100 detected by the below-described discharge temperature sensor 111 (temperature detection unit). The calculation of wetness degree performed by the wetness degree calculation unit 13 will be described below in greater detail.

Again referring to FIG. 1, in the compressor 100, a discharge-side pipe 110 is connected to the discharge side where the high-pressure gaseous refrigerant after compression is discharged, and an intake-side pipe 120 is connected to the intake side where the low-pressure gaseous refrigerant after evaporation by an evaporator is taken in. The discharge-side pipe 110 is connected at one end thereof to the discharge side of the compressor 100 and connected at the other end thereof to the first port of a four-way switching valve 230. The intake-side pipe 120 is connected at one end thereof to the second port of the four-way switching valve 230 and connected at the other end thereof to the intake side of the compressor 100.

The third port of the four-way switching valve 230 is connected to gaseous refrigerant pipe located in the heat source unit, and the fourth port thereof is connected by a pipe to the heat-source-side heat exchanger 200. The four-way switching valve 230 is switched between a state in which the first port and the fourth port communicate with each other and the second port and the third port communicate with each other (the state shown by a solid line in FIG. 1) and a state in which the first port and the third port communicate with each other and the second port and the fourth port communicate with each other (the state shown by a broken line in FIG. 1). The circulation direction of the refrigerant in the refrigerant circuit is reversed by the switching operation of the four-way switching valve 230.

The discharge temperature sensor 111 and a discharge pressure sensor 112 are provided in the discharge-side pipe 110 of the compressor 100. The discharge temperature sensor 111 detects the temperature of the high-pressure gaseous refrigerant after compression performed by the compressor 100. The discharge pressure sensor 112 detects the pressure of the high-pressure gaseous refrigerant after compression performed by the compressor 100.

An intake temperature sensor 121 and an intake pressure sensor 122 are provided in the intake-side pipe 120 of the compressor 100. The intake temperature sensor 121 detects the temperature of the low-pressure gaseous refrigerant taken into the compressor 100. The intake pressure sensor 122 detects the pressure of the low-pressure gaseous refrigerant taken into the compressor 100.

The heat-source-side heat exchanger 200 is, for example, a fin-and-tube heat exchanger of a cross fin system. A heat-source-side heat exchanger temperature sensor 22 is provided in the intermediate path of the heat-source-side heat exchanger 200. The heat source unit 1 is provided with a fan 210 that blows external air toward the heat-source-side heat exchanger 200. Heat exchange is performed between the external air blown onto the heat-source-side heat exchanger 200 and the refrigerant flowing in the heat-source-side heat exchanger 200 (from point B to point C shown in FIG. 3 during a cooling operation, and from point E to point A in FIG. 3 during a warming operation). The fan 210 is rotationally driven by a fan motor 2101. An external air temperature sensor 211 for measuring the external air temperature is provided at a position downstream of the air flow generated by the fan 210.

The liquid pipe motor-operated valve 220 is a motor-operated valve with an adjustable opening degree that is provided in the liquid refrigerant pipe 20 located in the heat source unit. During the cooling operation in which the heat-source-side heat exchanger 200 functions as a condenser (the four-way switching valve 230 is in the state shown by a solid line in FIG. 1), the liquid pipe motor-operated valve 220 regulates the flow rate of the high-pressure refrigerant that is discharged from the compressor 100 and flows into the heat-source-side heat exchanger 200, and during the warming operation in which the heat-source-side heat exchanger 200 functions as an evaporator (the four-way switching valve 230 is in the state shown by a broken line in FIG. 1), the liquid pipe motor-operated valve causes throttle expansion of the condensed high-pressure liquid refrigerant in the utilization-side heat exchanger and causes the refrigerant to flow into the heat-source-side heat exchanger 200. The saturation pressure of the refrigerant in the heat-source-side heat exchanger 200 is recalculated on the basis of the detection temperature of the heat-source-side heat exchanger temperature sensor 22, and the control unit 11 determines the opening degree of the liquid pipe motor-operated valve 220, the drive frequency of the compressor 100, and the revolution speed of the fan motor 2101 so that the saturation pressure becomes the predetermined pressure.

The liquid refrigerant pipe 20 located in the heat source unit is a refrigerant pipe connecting the heat-source-side heat exchanger 200 and the liquid refrigerant connection pipe 2. A closing valve 21 is provided in the connection port of the liquid refrigerant pipe 20 located in the heat source unit at the side of connection to the liquid refrigerant connection pipe 2. A supercooling heat exchanger 42 is provided at a location between the closing valve 21 and the liquid pipe motor-operated valve 220 of the liquid refrigerant pipe 20 located in the heat source unit. The supercooling heat exchanger 42 is, for example, a plate-type heat exchanger and causes heat exchange between the refrigerant flowing in the below-described supercooling refrigerant pipe 40 and the liquid refrigerant flowing in the liquid refrigerant pipe 20 located in the heat source unit.

The gaseous refrigerant pipe 30 located in the heat source unit is a refrigerant pipe connecting the gaseous refrigerant connection pipe 3 to the intake-side pipe 120 or the discharge-side pipe 110 by means of the four-way switching valve 230. A closing valve 31 is provided in the connection port of the gaseous refrigerant pipe 30 located in the heat source unit at the side of connection to the gaseous refrigerant connection pipe 3. The closing valve 21 and the closing valve 31 are closed to prevent the refrigerant located inside the heat source unit 1 from leaking while the heat source unit 1 is transported to the installation site and till the heat source unit 1 is connected to the already installed refrigerant circuit.

The supercooling refrigerant pipe 40 is a refrigerant pipe that is branched off from a location between the closing valve 21 and the liquid pipe motor-operated valve 220 of the liquid refrigerant pipe 20 located in the heat source unit and connected to the intake-side pipe 120 through the supercooling heat exchanger 42. The supercooling refrigerant pipe 40 is provided with a supercooling liquid pipe motor-operated valve 41 at a position upstream of the supercooling heat exchanger 42 in the flow direction of the refrigerant flowing inside the supercooling refrigerant pipe 40. The supercooling liquid pipe motor-operated valve 41 causes throttle expansion of the liquid refrigerant branched off from the liquid refrigerant pipe 20 located in the heat source unit. The liquid refrigerant with the temperature decreased by such throttle expansion flows into the supercooling heat exchanger 42. The liquid refrigerant flowing in the liquid refrigerant pipe 20 located in the heat source unit is cooled by heat exchange in the supercooling heat exchanger 42 with the liquid refrigerant flowing in the supercooling refrigerant pipe 40 and the supercooling degree increases (from point C to point D in FIG. 3). Where the supercooling degree of the liquid refrigerant flowing in the liquid refrigerant pipe 20 located in the heat source unit is increased, the efficiency of the refrigeration cycle increases.

The bypass pipe 50 is a refrigerant pipe that is branched off from the liquid refrigerant pipe 20 located in the heat source unit (in the present embodiment, between the supercooling heat exchanger 42 and the liquid pipe motor-operated valve 220) and connected to a location between the supercooling liquid pipe motor-operated valve 41 and the supercooling heat exchanger 42 of the supercooling refrigerant pipe 40. In the present embodiment, the branched portion of the bypass pipe 50 from the liquid refrigerant pipe 20 located in the heat source unit is shared with the supercooling refrigerant pipe 40. Since the supercooling refrigerant pipe 40 is connected to the intake-side pipe 120, the bypass pipe 50 causes the liquid refrigerant inside the liquid refrigerant pipe 20 located in the heat source unit to bypass to the intake-side pipe 120. In the present embodiment, the end of the bypass pipe 50 is connected to a location between the supercooling liquid pipe motor-operated valve 41 and the supercooling heat exchanger 42 of the supercooling refrigerant pipe 40, rather than at the intake-side pipe 120. As a result, the supercooling heat exchanger 42 is caused to function as a buffer storing the liquid refrigerant that has escaped to the bypass pipe 50.

A pressure regulating valve 51 is provided in the bypass pipe 50. The pressure regulating valve 51 is opened by a pressure that exceeds a preset reference pressure value. In the present embodiment, the reference pressure value is 3.3 Mpa.

Where the control unit 11 stops the operation of the compressor 100, the circulation of refrigerant in the refrigerant circuit is stopped. Therefore, the liquid refrigerant is enclosed in the liquid refrigerant connection pipe 2. In this case, the temperature of the enclosed liquid refrigerant is gradually increased by heat transfer of the liquid refrigerant connection pipe 2 till the temperature becomes equal to the external air temperature. The liquid refrigerant expands inside the liquid refrigerant connection pipe 2 and the pressure thereof rises following this increase in temperature. The working refrigerant prior to updating in the heat source unit 1 is, for example, R22, which is an HCFC refrigerant, and in the present embodiment, the update working refrigerant in the heat source unit 1 is R410A, which is a HFC refrigerant. This is because, the update working refrigerant should be a refrigerant with a low ozone depletion potential.

The liquid refrigerant connection pipe 2 is installed under an assumption that the pressure applied to the liquid refrigerant connection pipe 2 during the aforementioned pressure increase will be about 3.3 MPa, based on an assumption that the working refrigerant is R22. However, since the critical pressure of R410A is higher than that of R22, the pressure applied to the liquid refrigerant connection pipe 2 during the aforementioned pressure increase has the potential to become about 4 Mpa and the pressure applied to the liquid refrigerant connection pipe 2 approaches the upper limit value of pressure resistance of the liquid refrigerant connection pipe 2. For this reason, it is preferred that a liquid refrigerant escape mechanism be provided that will allow the liquid refrigerant to escape from the liquid refrigerant connection pipe 2 when the pressure of liquid refrigerant inside the liquid refrigerant connection pipe 2 exceeds a pressure of about 3.3 Mpa, which is an assumed value at the initial stage of installation.

Where the pressure regulating valve 51 in which the reference pressure value actuating the valve is 3.3 Mpa is provided in the bypass pipe 50, the pressure regulating valve 51 functions as the liquid refrigerant escape mechanism. Therefore, the pressure acting upon the liquid refrigerant connection pipe 2 during the aforementioned pressure increase can be fit into the range assumed during the installation of the liquid refrigerant connection pipe 2.

Furthermore, by using the pressure regulating valve 51, it is possible to provide the liquid refrigerant escape mechanism in a simple manner and at a low cost. For example, when the liquid refrigerant escape mechanism is realized by monitoring the pressure inside the liquid refrigerant connection pipe 2 and controlling the opening degree of the supercooling liquid pipe motor-operated valve 41, the following demerits are encountered: (1) the pressure should be continuously monitored as long as air conditioning is stopped, and power consumption is therefore increased; (2) complex control such as opening degree control of the supercooling liquid pipe motor-operated valve 41 is required and cost is therefore increased. By contrast, when the pressure regulating valve 51 is used in the liquid refrigerant escape mechanism, since the pressure regulating valve 51 is automatically actuated at a reference pressure value (3.3 Mpa in the present embodiment), it is essentially unnecessary to monitor and control the pressure. Therefore, by using the pressure regulating valve 51, it is possible to provide the liquid refrigerant escape mechanism in a simple manner and at a low cost.

A second liquid refrigerant escape mechanism 70 is a liquid refrigerant escape mechanism that is different from the pressure regulating valve 51 and allows the liquid refrigerant located inside the liquid refrigerant connection pipe 2 to escape from the liquid refrigerant connection pipe 2. The second liquid refrigerant escape mechanism 70 is constituted by a refrigerant regulator 61, a liquid refrigerant branched pipe 72, and an intake-side connection pipe 73.

The refrigerant regulator 61 is a tank storing the refrigerant. Where the working refrigerant (for example, R410A) that is loaded into the refrigerant circuit after updating with the heat source unit 1 is loaded in advance into the refrigerant regulator 61, the cylinder operation for loading the refrigerant in the event of heat source unit update becomes unnecessary. The liquid refrigerant branched pipe 72 is a refrigerant pipe that is branched off from the liquid refrigerant pipe 20, which is located in the heat source unit, and connected to the refrigerant regulator 61. One end of the liquid refrigerant branched pipe 72 connected to the refrigerant regulator 61 is open at a position above the liquid level of liquid refrigerant stored in the refrigerant regulator 61. The intake-side connection pipe 73 is a refrigerant pipe connected to the refrigerant regulator 61 and the intake-side pipe 120. One end of the intake-side connection pipe 73 connected to the refrigerant regulator 61 is open at a position above the liquid level of liquid refrigerant stored in the refrigerant regulator 61.

When the temperature of liquid refrigerant enclosed in the liquid refrigerant connection pipe 2 rises and the liquid refrigerant expands after the compressor 100 is stopped, the liquid refrigerant is introduced into the refrigerant regulator 61 even if the pressure of the liquid refrigerant is less than 3.3 Mpa, which is the reference pressure value of the pressure regulating valve 51. This effect can be explained as follows. Since the intake-side connection pipe 73 is connected to the intake-side pipe 120 through which the low-pressure gaseous refrigerant passes, the pressure inside the refrigerant regulator 61 becomes lower than the pressure inside the liquid refrigerant connection pipe 2 which is in principle equal to the pressure inside the discharge-side pipe 110 that discharges the high-pressure gaseous refrigerant, and the liquid refrigerant enclosed in the liquid refrigerant connection pipe 2 is sucked into the refrigerant regulator 61 from the refrigerant pipe 20 located in the heat source unit and communicating with the liquid refrigerant connection pipe 2 due to the difference between the pressure inside the liquid refrigerant connection pipe 2 and the pressure inside the refrigerant regulator 61. For this reason, the actuation frequency of the pressure regulating valve 51 is reduced and the introduction of the liquid refrigerant into the intake-side pipe 120 can be inhibited. Therefore, the probability of the compressor 100 assuming a liquid compression state when air conditioning is restarted can be reduced.

The liquid refrigerant branched pipe 72 is provided with a liquid refrigerant branched pipe electromagnetic valve 721. The intake-side connection pipe 73 is provided with an intake-side connection pipe electromagnetic valve 731. The control unit 11 controls opening and closing of the liquid refrigerant branched pipe electromagnetic valve 721 and the intake-side connection pipe electromagnetic valve 731 in the below-described manner when the compressor 100 is caused to make a transition from the operation state to the stop state.

When air conditioning is stopped, in order to cause the compressor 100 to make a transition from the operation state to the stop state, the control unit 11 stops power supply to the motor driving the compressor 100 and also starts the first control of setting the liquid refrigerant branched pipe electromagnetic valve 721 to the closed state and setting the intake-side connection pipe electromagnetic valve 731 to the open state. In the first control, the refrigerant regulator 61 communicates only with the intake-side pipe 120. Even when the control unit 11 stops power supply to the motor for driving the compressor 100, the rotation of the compressor 100 is not stopped immediately and the refrigerant still circulates in the refrigerant circuit. Therefore, the pressure inside the intake-side pipe 120 decreases and the inside of the refrigerant regulator 61 communicating with the intake-side pipe 120 is depressurized.

When the set time interval that has been set in advance elapses, the control unit 11 stops the first control and starts the second control of setting the liquid refrigerant branched pipe electromagnetic valve 721 to the open state and setting the intake-side connection pipe electromagnetic valve 731 to the closed state. In the second control, the refrigerant regulator 61 communicates only with the refrigerant pipe 20 located in the heat source unit and communicating with the liquid refrigerant connection pipe 2. Since the inside of the refrigerant regulator 61 has been depressurized in the first control, the liquid refrigerant enclosed in the liquid refrigerant connection pipe 2 is sucked into the refrigerant regulator 61 and escapes from the liquid refrigerant connection pipe 2 due to the difference between the pressure inside the liquid refrigerant connection pipe 2 and the pressure inside the refrigerant regulator 61. The amount of the liquid refrigerant that escapes from the liquid refrigerant connection pipe 2 is determined by the degree of depressurization inside the refrigerant regulator 61, and the degree of depressurization is determined by the continuation time of the first control. Therefore, the aforementioned set time interval is set under an assumption that the amount of liquid refrigerant that should escape is at a maximum, that is, the length of the liquid refrigerant connection pipe 2 is at a maximum and the predicted external air temperature is at a maximum.

Where an excess amount of the refrigerant escapes to the refrigerant regulator 61 when air conditioning is stopped, the efficiency of refrigeration cycle decreases when air conditioning is restarted. Therefore, in the present embodiment, the time interval of the second control is also preset and the control unit 11 sets both the liquid refrigerant branched pipe electromagnetic valve 721 and the intake-side connection pipe electromagnetic valve 731 to the closed state after the end of the second control.

The liquid refrigerant loading mechanism 60 is a mechanism that loads the refrigerant stored in the refrigerant regulator 61 into the refrigerant circuit. The liquid refrigerant loading mechanism 60 also functions as a mechanism that causes the refrigerant that has escaped from the liquid refrigerant connection pipe 2 and has been stored in the refrigerant regulator 61 to circulate to the intake-side pipe 120 when the operation of the compressor 100 is restarted and the circulation of refrigerant in the refrigerant circuit is restarted. The liquid refrigerant loading mechanism 60 is provided with the refrigerant regulator 61, an introducing pipe 62, a lead-out pipe 63, an introducing pipe electromagnetic valve 621, and a lead-out pipe motor-operated valve 631. The refrigerant regulator 61 is also used as the second liquid refrigerant escape mechanism 70.

The introducing pipe 62 is a refrigerant pipe that is branched off from the discharge-side pipe 110 and connected to the refrigerant regulator 61. One end of the introducing pipe 62 connected to the refrigerant regulator 61 is open at a location above the liquid level of liquid refrigerant stored in the refrigerant regulator 61. In the present embodiment, the introducing pipe 62 and the liquid refrigerant branched pipe 72 are connected to each other prior to being connected to the refrigerant regulator 61, combined in one pipe and then connected to the refrigerant regulator 61. The introducing pipe electromagnetic valve 621 is provided in the introducing pipe 62 at a location above the connection portion with the liquid refrigerant branched pipe 72.

The lead-out pipe 63 is a second refrigerant pipe that is connected to the refrigerant regulator 61 and the intake-side pipe 120, differently from the intake-side connection pipe 73. One end of the lead-out pipe 63 connected to the refrigerant regulator 61 is open at a location below the liquid level of liquid refrigerant stored in the refrigerant regulator 61. The lead-out pipe motor-operated valve 631 is provided in the lead-out pipe 63. In the present embodiment, the lead-out pipe 63 and the intake-side connection pipe 73 are connected to each other at the intake-side pipe 120 side positioned downstream of the lead-out pipe motor-operated valve 631 and introducing pipe electromagnetic valve 621, combined in one pipe and then connected to the intake-side pipe 120.

Where the control unit 11 sets the introducing pipe electromagnetic valve 621 to an open state to start the operation of loading the refrigerant into the refrigerant circuit, the high-pressure gaseous refrigerant discharged from the compressor 100 is introduced into the refrigerant regulator 61 and the liquid refrigerant stored in the refrigerant regulator 61 is pressurized. The pressurized liquid refrigerant is pushed out of the refrigerant regulator 61 into the lead-out pipe 63, and the amount thereof corresponding to the opening degree of the lead-out pipe motor-operated valve 631 is loaded into the intake-side pipe 120. In order to prevent liquid compression in the compressor 100, the wetness degree calculation unit 13 calculates the wetness degree of the intake portion of the compressor 100 on the basis of the discharged gas temperature measured by the discharge temperature sensor 111, and the control unit 11 controls the opening degree of the lead-out pipe motor-operated valve 631 so that the wetness degree does not exceed a predetermined value.

Figure 4:
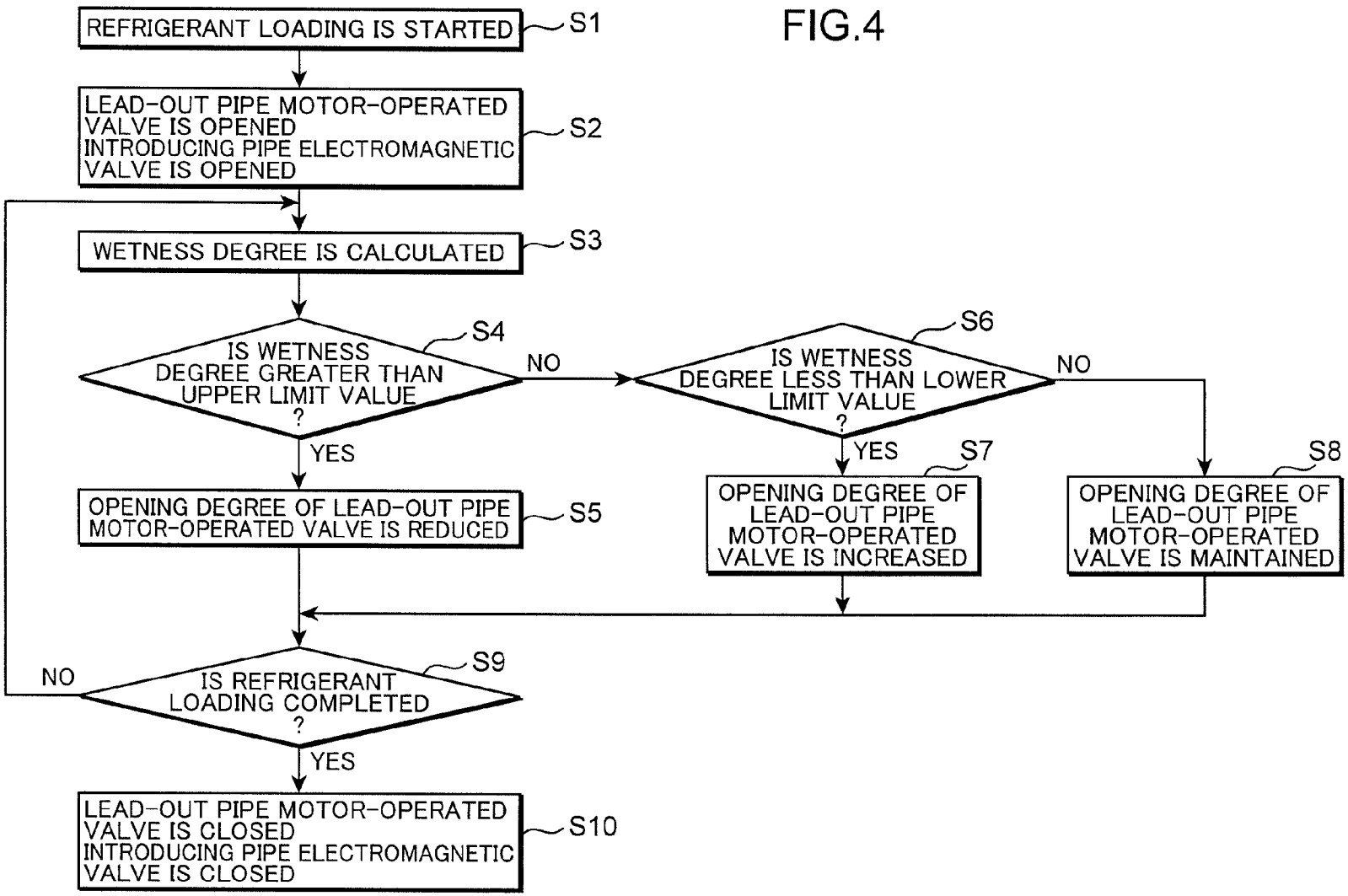
FIG. 4 is a flowchart illustrating in detail the refrigerant loading operation in the heat source unit according to Embodiment 1 of the present invention.

The operation of loading the refrigerant including the calculation of wetness degree performed by the wetness degree calculation unit 13 and the opening degree control of the lead-out pipe motor-operated valve 631 performed by the control unit 11 will be explained below in detail with reference to FIGS. 3 and 4. As mentioned above, FIG. 3 is a Mollier diagram (pressure-specific enthalpy diagram, p-h diagram) illustrating a refrigeration cycle in the refrigerant circuit constituted by providing the heat source unit 1. FIG. 4 is a flowchart illustrating in detail the refrigerant loading operation in the heat source unit 1.

As shown in FIG. 3 where loading of the refrigerant into the refrigerant circuit is started, the liquid refrigerant is led out to the intake-side pipe 120 and therefore the state of the refrigerant taken into the compressor 100 changes from superheated vapor to wetted vapor (from point A to point A'). On the segment EA in FIG. 3, the pressure and temperature of the refrigerant are constant (equal to saturation temperature and saturation pressure). Therefore, the wetness degree in point A' on the segment EA cannot be calculated by using the refrigerant temperature measured by the intake temperature sensor 121 or the refrigerant pressure measured by the intake pressure sensor 122. For this reason, the wetness degree calculation unit 13 calculates the wetness degree on the basis of the temperature (superheating degree) of gaseous refrigerant (discharged gas), which is discharged from the compressor 100, that has been measured by the discharge temperature sensor 111.

The saturation temperature at the time the discharged gas is a saturated vapor (point S) is uniquely correlated with the discharged gas pressure and therefore can be calculated from the pressure measured by the discharge pressure sensor 112. Accordingly, the superheating degree of the discharged gas can be calculated by determining the difference between the temperature of the discharged gas measured by the discharge temperature sensor 111 and the saturation temperature. Since the refrigerant temperature measured by the intake temperature sensor 121 and the refrigerant pressure measured by the intake pressure sensor 122 are equal to the saturation temperature and saturation pressure, respectively, the superheating degree SHs of the discharged gas at the time the refrigerant taken into the compressor 100 is a saturated vapor (point As) can be calculated by using both the measured refrigerant temperature and the measured refrigerant pressure. Where the superheating degree of the discharged gas is higher than SHs, the refrigerant taken into the compressor 100 is in the superheated vapor state, and where the superheating degree of the discharged gas is lower than SHs, the refrigerant is in the wetted vapor state. When loading of the refrigerant into the refrigerant circuit is started, the liquid refrigerant located in the refrigerant regulator 61 is led out to the intake-side pipe 120, and the state of the refrigerant taken into the compressor 100 changes from the superheated vapor to the wetted vapor, the state of the discharged gas changes from point B to point B' and the superheating degree of the discharged gas decreases from SH to SH'. The wetness degree calculation unit 13 calculates the wetness degree in point A' by calculating the difference between SHs and SH'.

When the refrigerant is loaded, the control unit 11 controls the opening degree of the lead-out pipe motor-operated valve 631 so as to confine the wetness degree of the intake portion of the compressor 100 between the upper limit value and the lower limit value that have been set in advance, that is, so that the superheating degree SH is between the values corresponding to the upper limit value and the lower limit value. When the wetness degree is too high, it is possible that the compressor 100 will fail due to liquid compression, and when the wetness degree is too low, the refrigerant loading rate is low and therefore a long time is required to complete the loading.

As shown in FIG. 4, where the operation of loading the refrigerant is started (step S1), the control unit 11 sets both the lead-out pipe motor-operated valve 631 and the introducing pipe electromagnetic valve 621 into the open state (step S2). The opening degree of the lead-out pipe motor-operated valve 631 at this time has been stored in advance in the storage unit 12. The wetness degree calculation unit 13 then calculates the wetness degree of the intake portion of the compressor 100 (step S3). When the wetness degree is higher than the above-mentioned upper limit value (YES in step S4), the control unit 11 decreases the opening degree of the lead-out pipe motor-operated valve 631 in order to reduce the amount of refrigerant loaded into the intake portion of the compressor 100 (step S5). When the wetness degree is equal to or less than the upper limit value (NO in step S4), the control unit 11 determines whether the wetness degree is less than the aforementioned lower limit value (step S6). When the wetness degree is less than the lower limit value (YES in step S6), the opening degree of the lead-out pipe motor-operated valve 631 is increased to increase the amount of loaded refrigerant (step S7). When the wetness degree is between the upper limit value and the lower limit value (NO in step S6), the refrigerant loading rate is adequate and therefore the control unit 11 maintains the opening degree of the lead-out pipe motor-operated valve 631 (step S8). Where the operation of loading the refrigerant is completed (step S9), the control unit 11 closes both the lead-out pipe motor-operated valve 631 and the introducing pipe electromagnetic valve 621 (step S10). A well-known technique, for example, such as disclosed in Patent Document 1 can be used for determining the completion of refrigerant loading.

With the heat source unit 1 according to Embodiment 1, the refrigerant located in the refrigerant regulator 61 is led out to the intake-side pipe 120 that is under a low pressure, by contrast with the case in which the refrigerant located in the refrigerant regulator 61 is led out to the liquid refrigerant pipe 20 located in the heat source unit through which the liquid refrigerant after condensation passes. For this reason, it is possible to increase the difference between the pressure inside the refrigerant regulator 61 that has increased because the high-pressure gaseous refrigerant discharged from the compressor 100 has been introduced into the refrigerant regulator 61 through the introducing pipe 62 and the pressure inside the intake-side pipe 120 into which the refrigerant stored inside the refrigerant regulator 61 is led out. Therefore, the refrigerant located inside the refrigerant regulator 61 can be rapidly loaded into the refrigerant circuit. As a result, the loading time that governs the rate in a trial run can be shortened and the trial run time can be shortened.

Further, with the heat source unit 1 according to Embodiment 1, the control unit 11 determines the opening degree of the lead-out pipe motor-operated valve 631 on the basis of the wetness degree calculated by the wetness degree calculation unit 13. Therefore, the occurrence of liquid compression in the compressor 100 and the resultant failure of the compressor 100 can be prevented.

Embodiment 2

Figure 5:
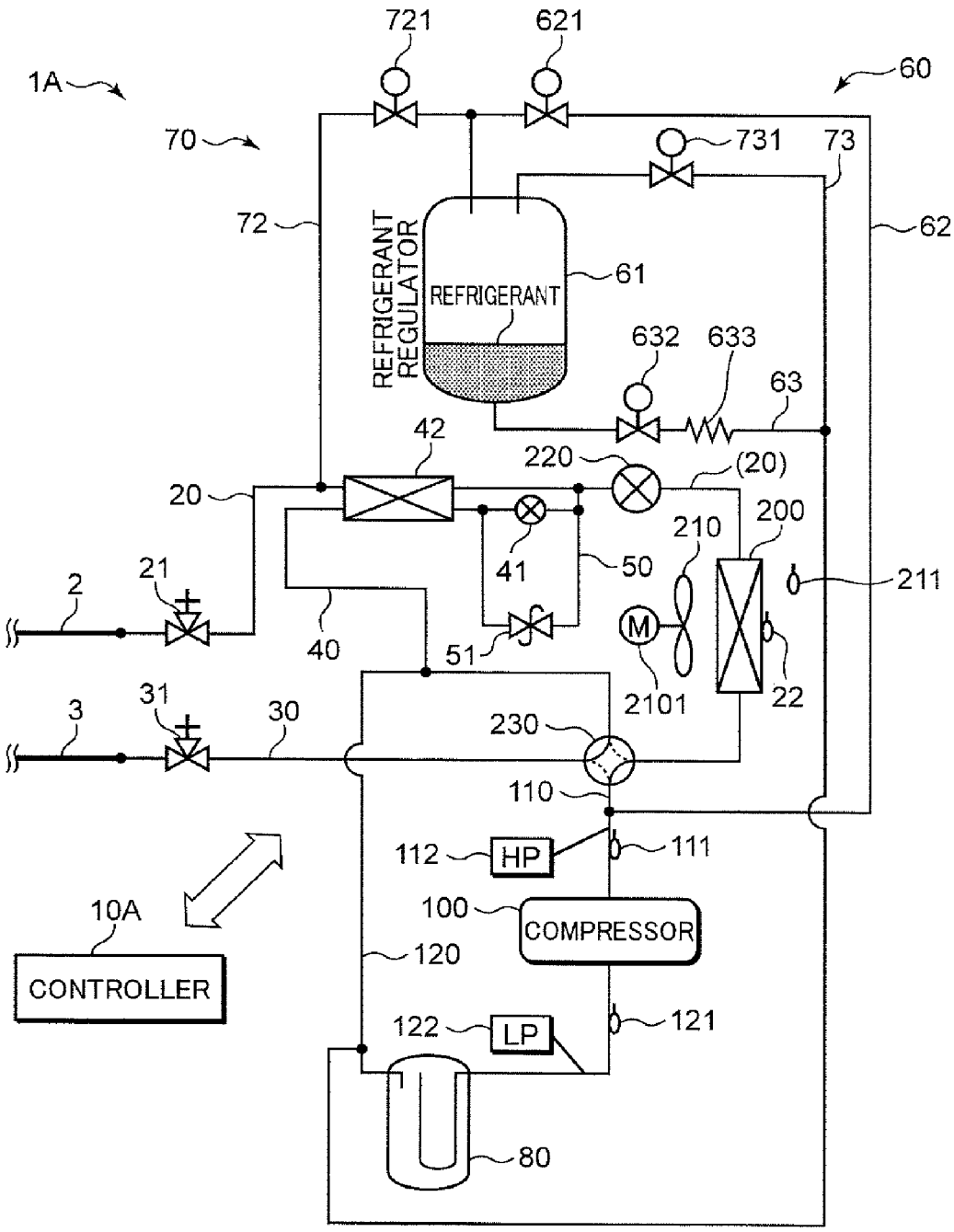
FIG. 5 is a schematic configuration diagram of a heat source unit according to Embodiment 2 of the present invention.
Figure 6:
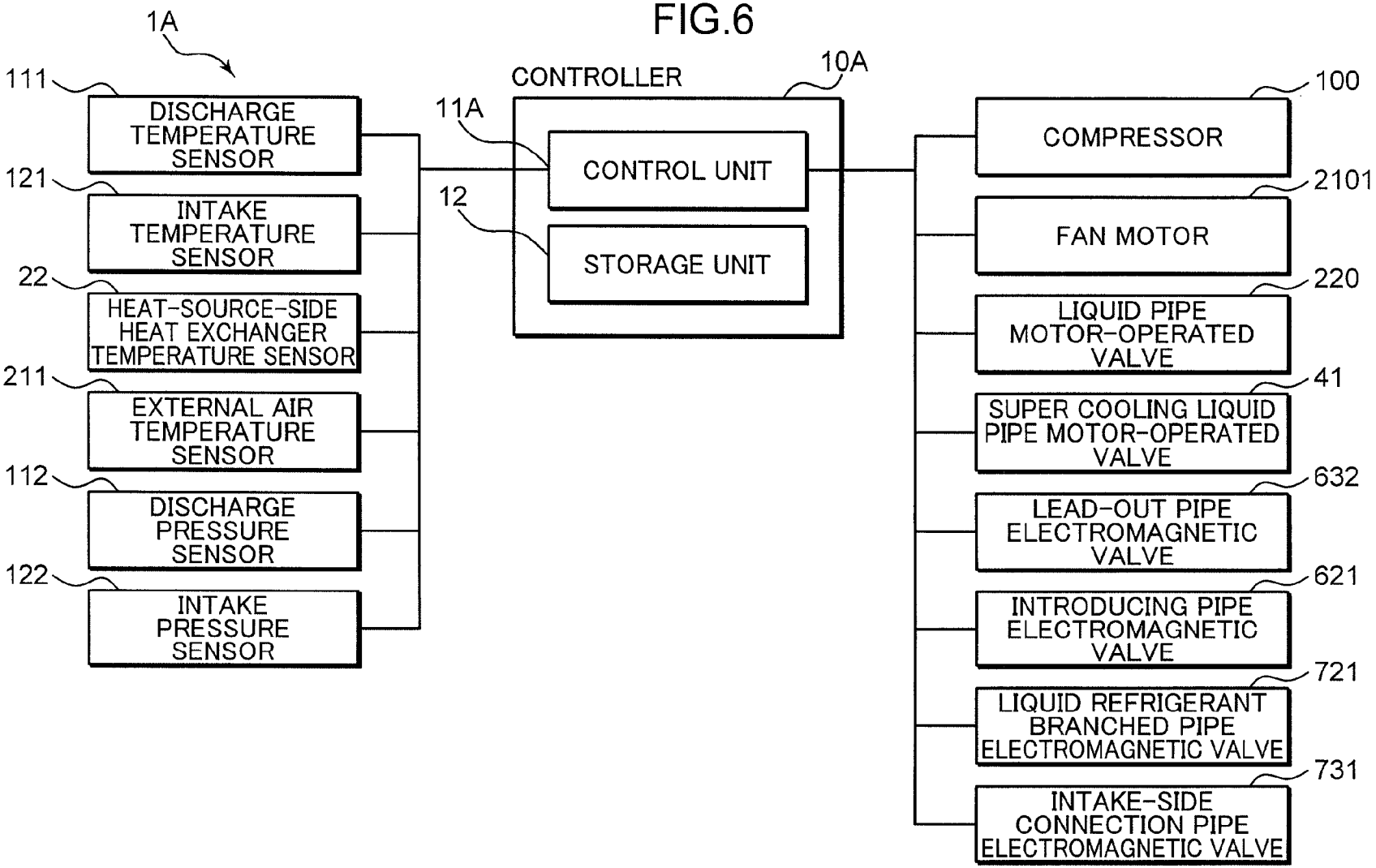
FIG. 6 is a functional block diagram illustrating the schematic configuration of the control system and principal structure of the heat source unit according to Embodiment 2 of the present invention.

FIG. 5 is a schematic configuration diagram of a heat source unit 1A according to Embodiment 2 of the present invention. FIG. 6 is a functional block diagram illustrating the schematic configuration of the control system and principal structure of the heat source unit 1A. In FIGS. 5 and 6, components identical to those of the heat source unit 1 according to Embodiment 1 are assigned with same reference numerals and symbols as in the heat source unit 1 shown in FIGS. 1 and 2 and the explanation thereof is herein omitted, unless such an explanation is specifically required.

The heat source unit 1A has an accumulator 80 provided in the intake-side pipe 120 of the heat source unit 1, and the lead-out pipe 63 provided with the lead-out pipe electromagnetic valve 632 and a capillary tube 633 (flow rate control mechanism) is connected to the intake-side pipe 120 positioned between the four-way switching valve 230 and the accumulator 80.

The accumulator 80 performs gas-liquid separation of the refrigerant flowing into the intake portion of the compressor 100 and only the gaseous refrigerant is taken into the compressor 23. Since the lead-out pipe 63 is connected at the aforementioned position upstream of the accumulator 80, the refrigerant from the refrigerant regulator 61 that has been led into the intake-side pipe 12 is subjected to gas-liquid separation in the accumulator 80 and then flows into the intake portion of the compressor 100. Therefore, the occurrence of liquid compression in the compressor 100 and the resultant failure of the compressor 100 can be prevented.

The lead-out pipe electromagnetic valve 632 is provided instead of the lead-out pipe motor-operated valve 631 of the heat source unit 1 according to Embodiment 1. The reason for using the electromagnetic valve, rather than the motor-operated valve can be explained as follows. Since the lead-out pipe 63 is connected upstream of the accumulator 80, it is not necessary to prevent liquid compression in the compressor 100 by controlling the flow rate of refrigerant that is led out from the refrigerant regulator 61 into the intake-side pipe 120 and therefore it is not necessary to use the motor-operated valve which is more expensive than the electromagnetic valve.

The capillary tube 633 (flow rate restricting mechanism) is provided between the lead-out pipe electromagnetic valve 632 and the point of connection to the intake-side pipe 120. The inner diameter and length of the capillary tube 633 are set such as to restrict the amount of the refrigerant stored in the refrigerant regulator 61 and led out to the intake-side pipe 120 to a value equal to or lower than the amount of refrigerant taken in from the accumulator 80 into the compressor 100. Where the flow rate of the refrigerant passing through the lead-out pipe electromagnetic valve 632 is equal to or less than the amount of refrigerant taken in from the accumulator 80 into the compressor 100, the capillary tube 633 is not required.

As shown in FIG. 6, the differences between the heat source unit 1A and the heat source unit 1 according to Embodiment 1 are that the former is provided with the lead-out pipe electromagnetic valve 632 instead of the lead-out pipe motor-operated valve 631 and a controller 10A is not provided with the wetness degree calculation unit 13. These differences between the heat source unit 1 and the heat source unit 1A stem from the fact that the heat source unit 1A is provided, as indicated hereinabove, with the accumulator 80 that performs gas-liquid separation of the refrigerant flowing into the intake portion of the compressor 100 and causes only the gaseous refrigerant to be taken into the compressor 23, thereby preventing liquid compression in the compressor 100. For this reason, the control of refrigerant loading performed by a control unit 11A provided with the controller 10A is different from the control of refrigerant loading performed by the control unit 11 provided with the controller 10 of the heat source unit 1.

Figure 7:
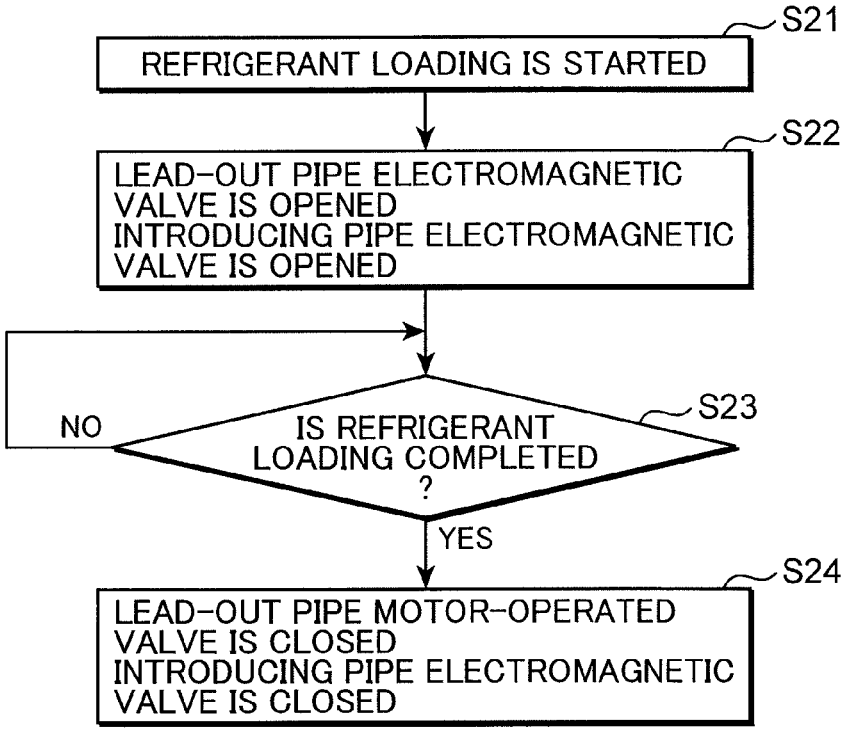
FIG. 7 is a flowchart illustrating in detail the refrigerant loading operation in the heat source unit according to Embodiment 2 of the present invention.

FIG. 7 is a flowchart illustrating in detail the refrigerant loading operation in the heat source unit 1A. Where refrigerant loading is started (step S21), the control unit 11A sets both the lead-out pipe electromagnetic valve 632 and the introducing pipe electromagnetic valve 621 to an open state (step S22). Where loading of the refrigerant is completed (step S23), the control unit 11 sets both the lead-out pipe electromagnetic valve 632 and the introducing pipe electromagnetic valve 621 to a closed state (step S24).

In the heat source unit 1A according to Embodiment 2, the refrigerant located in the refrigerant regulator 61 is led out into the low-pressure intake-side pipe 120, in the same manner as in the heat source unit 1 according to Embodiment 1. For this reason, it is possible to increase the difference between the pressure inside the refrigerant regulator 61 that has increased because the high-pressure gaseous refrigerant discharged from the compressor 100 has been introduced in the refrigerant regulator 61 through the introducing pipe 62 and the pressure inside the intake-side pipe 120 into which the refrigerant stored in the refrigerant regulator 61 is led out. Therefore, in the heat source unit 1A, the refrigerant located inside the refrigerant regulator 61 can be rapidly loaded into the refrigerant circuit in the same manner as in the heat source unit 1. As a result, the loading time that governs the rate in a trial run can be shortened and the trial run time can be shortened.

Further, with the heat source unit 1A according to Embodiment 2, since the refrigerant that has been led out from the refrigerant regulator 61 into the intake-side pipe 120 is subjected to gas-liquid separation in the accumulator 80 and then flows to the intake portion of the compressor 100, the occurrence of liquid compression in the compressor 100 and the resultant failure of the compressor 100 can be prevented.

Furthermore, with the heat source unit 1A according to Embodiment 2, the lead-out amount of the refrigerant stored in the refrigerant regulator 61 and led out to the intake-side pipe 120 is restricted by the capillary tube 633 to a value equal to or lower than the refrigerant amount taken in from the accumulator 80 into the compressor 100 and the refrigerant is loaded so that no refrigerant remains inside the accumulator 80. Therefore, the occurrence of error in determining the completion of loading that is caused by the refrigerant remaining inside the accumulator 80 and the resultant overloading of the refrigerant can be prevented.

The heat source unit 1 according to Embodiment 1 and the heat source unit 1A according to Embodiment 2 of the present invention are explained above, but the present invention is not limited to these embodiments and, for example, the following modified embodiments can be also considered.

(1) In the above-described embodiments, the heat source unit is described for an air conditioner of a two-pipe system that is switched between cooling operation and warming operation, but the present invention can be also applied to a heat source unit for use in an air condition of a three-pipe system of the so-called cooling/warming free type in which cooling and warming can be performed simultaneously.

(2) In the above-described embodiments, the heat source unit 1 is provided with only one compressor 100 of a single-stage system, but a multistage compressor may be also used, or a plurality of compressors may be used, with the number of operating compressor units being changed according to the load.

(3) In the configuration according to Embodiment 1, an accumulator can be provided in the intake-side pipe 120 and the lead-out pipe 63 can be connected between the accumulator and the compressor 100.

Essentially, the present invention provides a heat source unit of an air conditioner connected to a utilization unit provided with a utilization-side heat exchanger, including a compressor; a heat-source-side heat exchanger; a refrigerant regulator storing a refrigerant; an introducing pipe which is a pipe that is branched off from a discharge-side pipe of the compressor and connected to the refrigerant regulator, and introduces the refrigerant discharged from the compressor into the refrigerant regulator; and a lead-out pipe which is a pipe that is connected from the refrigerant regulator to an intake-side pipe of the compressor, and leads out the refrigerant stored in the refrigerant regulator into the intake-side pipe.

With such a configuration, the refrigerant located in the refrigerant regulator is led out to the intake-side pipe that is under a low pressure, by contrast with the case in which the refrigerant located in the refrigerant regulator is led out to the liquid pipe through which the liquid refrigerant after condensation passes. For this reason, it is possible to increase the difference between the pressure inside the refrigerant regulator that is under a high pressure because the high-pressure gaseous refrigerant discharged from the compressor has been introduced into the refrigerant regulator through the introducing pipe and the pressure inside the intake-side pipe into which the refrigerant stored inside the refrigerant regulator is led out. Therefore, the refrigerant located inside the refrigerant regulator can be rapidly loaded into the refrigerant circuit.

Thus, in accordance with the present invention, a labor-intensive cylinder operation becomes unnecessary when the refrigerant is loaded into the refrigerant circuit and the refrigerant located inside the refrigerant regulator can be rapidly loaded into the refrigerant circuit. Therefore, the loading time that governs the rate in a trial run can be shortened and the trial run time can be shortened.

In accordance with the present invention, it is preferred that the heat source unit further include a flow rate regulating mechanism provided in at least one of the introducing pipe and the lead-out pipe, and regulating a lead-out amount of the refrigerant stored in the refrigerant regulator and led out to the intake-side pipe, and a control unit that controls the flow rate regulating mechanism.

With such a configuration, the control unit controls the flow rate regulating mechanism and regulates the lead-out amount of the refrigerant that is led out to the intake-side pipe. Therefore, the occurrence of liquid compression in the compressor and the resultant failure of the compressor can be prevented.

In accordance with the present invention, it is further preferred that the flow rate regulating mechanism be a motor-operated valve with an adjustable opening degree that is provided in the lead-out pipe.

In accordance with the present invention, it is further preferred that the heat source unit further include a wetness degree calculation unit that calculates a wetness degree, which is a ratio of liquid refrigerant contained in the refrigerant flowing into an intake portion of the compressor, wherein the control unit determines an opening degree of the motor-operated valve on the basis of the wetness degree.

With such a configuration, the control unit determines the opening degree of the motor-operated valve on the basis of the wetness degree. Therefore, the occurrence of liquid compression in the compressor and the resultant failure of the compressor can be prevented more reliably.

In accordance with the present invention, it is further preferred that the heat source unit further include a temperature detection unit that detects a temperature of discharged gas of the compressor, wherein the wetness degree calculation unit calculates the wetness degree on the basis of the temperature of the discharged gas.

With such a configuration, the wetness degree can be easily calculated.

Further, in accordance with the present invention, it is preferred that in a configuration in which an accumulator is provided in the intake-side pipe, the lead-out pipe be connected to the intake-side pipe at a position upstream of the accumulator.

With such a configuration, the refrigerant led out from the refrigerant regulator into the intake-side pipe is subjected to gas-liquid separation in the accumulator and then sucked into the intake portion of the compressor. Therefore, the occurrence of liquid compression in the compressor and the resultant failure of the compressor can be prevented.

Further, in accordance with the present invention, it is preferred that the above-described configuration be provided with a flow rate restriction mechanism that is provided in the lead-out pipe and restricts a lead-out amount of the refrigerant stored in the refrigerant regulator and led out to the intake-side pipe, to a value equal to or less than the amount of the refrigerant taken in from the accumulator into the compressor.

With such a configuration, the refrigerant remains in the accumulator when the refrigerant is loaded and overloading of the refrigerant can be prevented.

The invention claimed is:

1. A heat source unit of an air conditioner having a refrigerant circuit, comprising:

a compressor;

a heat-source-side heat exchanger;

a refrigerant regulator storing a refrigerant;

an introducing pipe which is a pipe that is branched off from a discharge-side pipe of the compressor and connected to the refrigerant regulator, and introduces the refrigerant discharged from the compressor into the refrigerant regulator;

a lead-out pipe which is a pipe that is connected from the refrigerant regulator to an intake-side pipe of the compressor, and leads out the refrigerant stored in the refrigerant regulator into the intake-side pipe;

an introducing pipe electromagnetic valve provided in the introducing pipe;

a lead-out pipe motor-operated valve with an adjustable opening degree that is provided in the lead-out pipe, and regulating a lead-out amount of the refrigerant stored in the refrigerant regulator and led out to the intake-side pipe;

a liquid refrigerant branched pipe that is branched off from a liquid refrigerant pipe and connected to the refrigerant regulator;

an intake-side connection pipe connected to the refrigerant regulator and the intake-side pipe;

a liquid refrigerant branched pipe electromagnetic valve provided in the liquid refrigerant branched pipe;

an intake-side connection pipe electromagnetic valve provided in the intake-side connection pipe; and a control unit configured to open both the introducing pipe electromagnetic valve and the lead-out pipe motor-operated valve to load refrigerant stored in the refrigerant regulator into the refrigerant circuit and to close both the introducing pipe electromagnetic valve and the lead-out pipe motor-operated valve when the refrigerant circuit is loaded, wherein one end of the introducing pipe is connected to an upper part of the refrigerant regulator and located above a liquid level of liquid refrigerant stored in the refrigerant regulator, one end of the lead-out pipe is connected to a bottom of the refrigerant regulator and located below the liquid level of liquid refrigerant stored in the refrigerant regulator, one end of the liquid refrigerant branched pipe is connected to an upper part of the refrigerant regulator and located above the liquid level of liquid refrigerant stored in the refrigerant regulator, one end of the intake-side connection pipe is connected to an upper part of the refrigerant regulator and located above the liquid level of the liquid refrigerant stored in the refrigerant regulator, the control unit starts a first control of stopping the compressor, setting the liquid refrigerant branched pipe electromagnetic valve to the closed state and setting the intake-side connection pipe electromagnetic valve to an open state, whereby the refrigerant regulator communicates with the intake-side pipe in the first control, when the first control is completed, the control unit starts a second control of setting the liquid refrigerant branched pipe electromagnetic valve to the open state and setting the intake-side connection pipe electromagnetic valve to a closed state, whereby the refrigerant regulator communicates with the liquid refrigerant pipe, and when the second control is completed, the control unit sets both the liquid refrigerant branched pipe electromagnetic valve and the intake-side connection pipe electromagnetic valve to the closed state.

2. A heat source unit of an air conditioner having a refrigerant circuit, comprising:

a compressor;

a heat-source-side heat exchanger;

a refrigerant regulator storing a refrigerant;

an introducing pipe that is branched off from a discharge-side pipe of the compressor and connected to the refrigerant regulator, and introduces the refrigerant discharged from the compressor into the refrigerant regulator;

an accumulator provided in an intake-side pipe;

a lead-out pipe that is connected from the refrigerant regulator to the intake-side pipe of the compressor, and leads out the refrigerant stored in the refrigerant regulator into the intake-side pipe, the lead-out pipe being connected to the intake-side pipe at a position upstream of the accumulator;

an introducing pipe electromagnetic valve provided in the introducing pipe;

a lead-out pipe electromagnetic valve provided in the lead-out pipe;

a capillary tube that is provided in the lead-out pipe;

a liquid refrigerant branched pipe that is branched off from a liquid refrigerant pipe and connected to the refrigerant regulator;

an intake-side connection pipe connected to the refrigerant regulator and the intake-side pipe;

a liquid refrigerant branched pipe electromagnetic valve provided in the liquid refrigerant branched pipe;

an intake-side connection pipe electromagnetic valve provided in the intake-side connection pipe; and a control unit configured to open both the introducing pipe electromagnetic valve and the lead-out pipe electromagnetic valve to load refrigerant stored in the refrigerant regulator into the refrigerant circuit and to close both the introducing pipe electromagnetic valve and the lead-out pipe motor-operated valve when the refrigerant circuit is loaded, wherein one end of the introducing pipe is connected to an upper part of the refrigerant regulator and located above a liquid level of liquid refrigerant stored in the refrigerant regulator, one end of the lead-out pipe is connected to a bottom of the refrigerant regulator and located below the liquid level of liquid refrigerant stored in the refrigerant regulator, one end of the liquid refrigerant branched pipe is connected to an upper part of the refrigerant regulator and located above the lk uid level of lk uid refrigerant stored in the refrigerant regulator, one end of the intake-side connection pipe is connected to an upper part of the refrigerant regulator and located above the liquid level of liquid refrigerant stored in the refrigerant regulator, the control unit starts a first control of stopping the compressor, setting the liquid refrigerant branched pipe electromagnetic valve to a closed state and setting the intake-side connection pipe electromagnetic valve to an open state, whereby the refrigerant regulator communicates with the intake-side pipe in the first control, when the first control is completed, the control unit starts a second control of setting the liquid refrigerant branched pipe electromagnetic valve to the open state and setting the intake-side connection pipe electromagnetic valve to the closed state, whereby the refrigerant regulator communicates with the liquid refrigerant pipe, and when the second control is completed, the control unit sets both the liquid refrigerant branched pipe electromagnetic valve and the intake-side connection pipe electromagnetic valve to the closed state.

3. The heat source unit according to claim 1, further comprising:

a wetness degree calculation unit that calculates a wetness degree, which is a ratio of liquid refrigerant contained in the refrigerant flowing into an intake portion of the compressor, wherein the control unit determines an opening degree of the motor-operated valve on the basis of the wetness degree.

4. The heat source unit according to claim 3, further comprising:

a temperature detection unit that detects a temperature of discharged gas of the compressor, wherein the wetness degree calculation unit calculates the wetness degree on the basis of the temperature of the discharged gas.

5. The heat source unit according to claim 2, wherein the capillary tube restricts a lead-out amount of the refrigerant stored in the refrigerant regulator and led out to the intake-side pipe, to a value equal to or less than an amount of the refrigerant taken in from the accumulator into the compressor.

* * * * *